US009537204B2

(12) United States Patent
Cheng et al.

(10) Patent No.: US 9,537,204 B2
(45) Date of Patent: Jan. 3, 2017

(54) MULTI-CHANNEL MULTI-SECTOR SMART ANTENNA SYSTEM

(71) Applicant: Commsky Technologies, Inc., Santa Clara, CA (US)

(72) Inventors: Po-shin Cheng, Fremont, CA (US); Daniel Wang, San Jose, CA (US); Jun Shen, Palo Alto, CA (US); George Zhao, Palo Alto, CA (US)

(73) Assignee: Commsky Technologies, Inc., Santa Clara, CA (US)

( * ) Notice: Subject to any disclaimer, the term of this patent is extended or adjusted under 35 U.S.C. 154(b) by 582 days.

(21) Appl. No.: 13/872,078

(22) Filed: Apr. 27, 2013

(65) Prior Publication Data

US 2014/0320377 A1 Oct. 30, 2014

(51) Int. Cl.

| | |
|---|---|
| ***H01Q 1/38*** | (2006.01) |
| ***H01Q 19/10*** | (2006.01) |
| ***H01Q 19/30*** | (2006.01) |
| ***H01Q 21/20*** | (2006.01) |
| ***H01Q 21/24*** | (2006.01) |

(52) U.S. Cl.

CPC ..... *H01Q 1/38* (2013.01); *H01Q 19/108* (2013.01); *H01Q 19/30* (2013.01); *H01Q 21/20* (2013.01); *H01Q 21/24* (2013.01)

(58) Field of Classification Search

CPC ..... H01Q 21/24; H01Q 21/29; H01Q 21/293; H01Q 5/42; H01Q 5/49

USPC ..... 343/824.826

See application file for complete search history.

(56) References Cited

U.S. PATENT DOCUMENTS

| | | | | |
|---|---|---|---|---|
| 5,258,771 A * | 11/1993 | Praba | ..... | H01Q 11/08 343/844 |
| 6,208,299 B1 * | 3/2001 | Lindmark | ..... | H01Q 21/08 343/700 MS |
| 7,646,343 B2 * | 1/2010 | Shtrom | ..... | H01Q 3/242 343/700 MS |

(Continued)

FOREIGN PATENT DOCUMENTS

| | | |
|---|---|---|
| CN | 200420085994.3 | 9/2005 |
| CN | 200810196696.4 | 2/2009 |

(Continued)

*Primary Examiner* — Graham Smith
*Assistant Examiner* — Daniel J Munoz
(74) *Attorney, Agent, or Firm* — Joe Zheng

(57) ABSTRACT

Techniques of designing a smart antenna system are described. An antenna system includes at least two integrated antenna units arranged with a predefined angular angle therebetween to form a desired antenna pattern without any significant nulls. According to one aspect of the techniques, at least two sets of antenna units are interlaced but polarized differently to form an integrated antenna unit. Each of the antenna units is formed with an array of antennas. The antennas in an array or the antenna units in an integrated antenna unit can be selectively energized to form a desired antenna pattern in accordance with a signal determined from radio frequency signals communicated between a device equipped with the antenna system and another device (e.g., a Wi-Fi router in communication with a mobile device), where the desired antenna pattern provides an optimized antenna pattern to facilitate seamless or QoS communication between the two devices.

10 Claims, 8 Drawing Sheets

(56) References Cited

U.S. PATENT DOCUMENTS

| | | | | |
|---|---|---|---|---|
| 2002/0021246 | A1* | 2/2002 | Martek | H01Q 1/523 342/373 |
| 2007/0279310 | A1* | 12/2007 | Tsai | H01Q 1/1207 343/795 |
| 2014/0009347 | A1* | 1/2014 | Bertin | H01Q 1/2258 343/725 |
| 2014/0066757 | A1* | 3/2014 | Chayat | G01S 13/89 600/430 |

FOREIGN PATENT DOCUMENTS

| | | |
|---|---|---|
| CN | 201210149286.0 | 9/2012 |
| JP | 2001244731 | 9/2001 |

* cited by examiner

Elevation view of an antenna unit (Channel 1) serving one sector of the Azimuthal Span

MULTI-CHANNEL MULTI-SECTOR SMART ANTENNA SYSTEM

BACKGROUND OF THE INVENTION

Field of Invention

The invention generally is related to the area of antennas, and more particularly related to integrated antenna arrays structured in a way and controlled electronically to form a desired antenna pattern without developing a null.

Related Art

An antenna system is an indispensable component in communication systems. In conventional wireless communications, a single antenna is used at the source, and another single antenna is used at the destination. This is called SISO (single input, single output). Such systems are vulnerable to problems caused by multipath effects. When an electromagnetic field (EM field) is met with obstructions such as hills, canyons, buildings, and utility wires, the wavefronts are scattered, and thus they take many paths to reach the destination. The late arrival of scattered portions of the signal causes problems such as fading, cut-out (cliff effect), and intermittent reception (picket fencing). In a digital communications system like the Internet, it can cause a reduction in data speed and an increase in the number of errors.

The use of smart antennas can reduce or eliminate the trouble caused by multipath wave propagation. A smart antenna is a digital wireless communications antenna system that takes advantage of diversity effect at the source (transmitter), the destination (receiver), or both. Diversity effect involves the transmission and/or reception of multiple radio frequency (RF) waves to increase data speed and reduce the error rate. Smart antennas (also known as adaptive array antennas, multiple antennas and, recently, MIMO) are antenna arrays with smart signal processing algorithms used to identify spatial signal signature such as the direction of arrival (DOA) of the signal, and use it to calculate beamforming vectors, to track and locate the antenna beam on a mobile target.

Most of the smart antennas in use today have some undesired nulls in the antenna patterns. In radio electronics, a null is an area or vector in an antenna radiation pattern where the signal cancels out almost entirely. If not carefully planned, nulls can unintentionally prevent reception of a signal and fail to transmit a signal. There is a need for an antenna system that has a controllable antenna pattern without developing nulls.

SUMMARY OF THE INVENTION

This section is for the purpose of summarizing some aspects of the present invention and to briefly introduce some preferred embodiments. Simplifications or omissions in this section as well as in the abstract may be made to avoid obscuring the purpose of this section and the abstract. Such simplifications or omissions are not intended to limit the scope of the present invention.

The present invention generally pertains to designs of antenna arrays structured in a way to form a desired antenna pattern without developing a null. According to one aspect of the present invention, at least two sets of antenna units are interlaced but polarized differently to form an integrated antenna unit. Each of the antenna units is formed with an array of antennas. According to another aspect of the present invention, the antennas in an array are identical in structure and spaced apart to accommodate another array of antennas in an interlacing fashion to form an integrated antenna unit. According to still another aspect of the present invention, an antenna system includes at least two of such integrated antenna units arranged with a predefined angular angle therebetween to form a desired antenna pattern without any significant nulls. According to yet another aspect of the present invention, the antennas in an array or the antenna units in an integrated antenna unit can be selectively energized to form a desired antenna pattern in accordance with a signal determined from radio signals communicated between a device equipped with the antenna system and another device (e.g., a Wi-Fi router in communication with a mobile device), where the desired antenna pattern provides an optimized antenna pattern to facilitate seamless or QoS communication between the two devices.

Depending on implementation, the present invention may be implemented as a method, an apparatus or part of a system. According to one embodiment, the present invention is an antenna system that comprises: a substrate; and at least a first antenna unit and a second antenna unit integrated to form an integrated antenna unit bonded to the substrate, each of the first and second antenna units being formed with an array of antennas, where the first and second antenna units are arranged in a way that the antennas in the first antenna unit are interlaced with the antennas in the second antenna unit. Depending on implementation, the antenna system includes the first and second antenna units arranged orthogonally or with a predefined angle, or additional antenna units to reshape a resulting antenna pattern. The antenna system further comprises at least another integrated antenna unit substantially similar to the integrated antenna unit, wherein the integrated antenna unit and the another integrated antenna unit are bonded to a metal substrate with a predefined angle therebetween.

According to another embodiment, the present invention is an antenna system that comprises: at least a first integrated antenna unit and a second integrated antenna unit arranged with a predefined angular angle therebetween, each of the first and second integrated antenna units including a first antenna unit and a second antenna unit, each of the first and second antenna units being formed with an array of antennas, wherein the first and second antenna units arranged in a way that the antennas in the first antenna unit are interlaced with the antennas in the second antenna unit.

One of the objects, features and advantages of the present invention is to provide a smart antenna that is amenable to small footprint, broad operating wavelength range, enhanced antenna pattern, lower cost, and easier manufacturing process. Other objects, features, benefits and advantages, together with the foregoing, are attained in the exercise of the invention in the following description and resulting in the embodiment illustrated in the accompanying drawings.

BRIEF DESCRIPTION OF THE FIGURES

These and other features, aspects, and advantages of the present invention will be better understood with regard to the following description, appended claims, and accompanying drawings where:

DETAILED DESCRIPTION OF THE INVENTION

Figure 1:
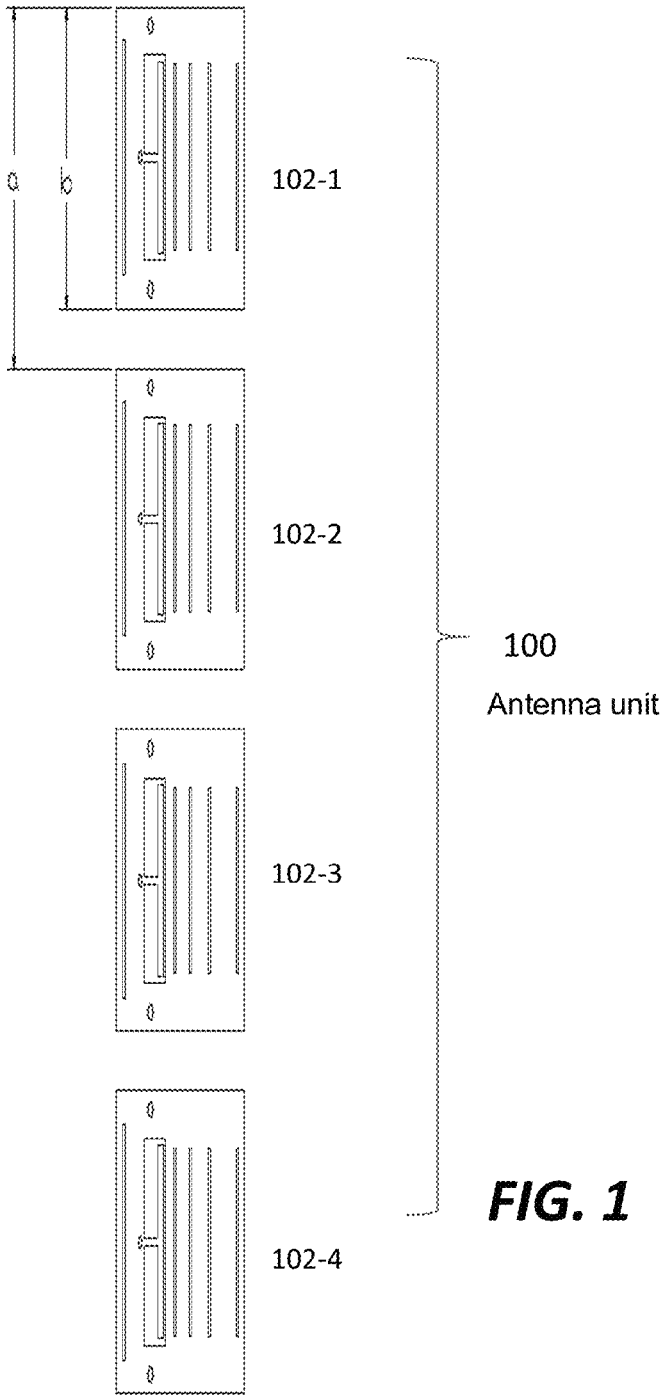
FIG. 1 shows an elevation view of an antenna unit serving one sector of an azimuthal span.

The detailed description of the invention is presented largely in terms of procedures, steps, logic blocks, processing, and other symbolic representations that directly or indirectly resemble the operations of communication devices coupled to networks. These process descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Service providers are looking for antenna systems that provide high power gain with small physical size. Further, it is desirable to deploy an antenna system that is capable of delivering optimal radio frequency (RF) power covering a known span of azimuthal angles. One embodiment of the present invention provides a high-gain antenna system covering independently K different sectors, where each sector is defined by 360/K-degree azimuthal span, where K is an positive integer. In addition, an antenna system designed in accordance with the embodiment is capable of providing service covering multiple adjacent sectors simultaneously. This is made possible by putting multi-channel antennas physically right next to each other, where each of the antennas serves a different sector. The physical arrangement of the antennas is unique and compact, and provides the best performance possible for a desirable angular coverage without creating nulls within the desirable coverage areas.

According to one embodiment, the antenna system is designed initially for the 2×2 Multiple input/Multiple output (MIMO) Wi-Fi architecture. The same design is also applicable to the 3×3 MIMO. Those skilled in the art shall appreciate that the designs described herein is equally applicable to the N×M MIMO architectures. Some of the features, advantages and benefits in the present invention include:

- An antenna unit serving each channel covering one particular angular sector can be any type of antennas;
- A horizontally polarized antenna unit and a vertically polarized antenna unit are uniquely structured to form an integrated antenna unit to reduce the overall physical size of the antenna system;
- The antenna system may have a number of such integrated antenna units to form a designed antenna pattern, these integrated antenna units are arranged in such a way that the antenna system is able to cover K different sectors independently or multiple sectors simultaneously;
- Integrated antenna units serving different sectors are physically close to each other, which makes it possible for the antenna system to be placed in an enclosure.

Referring now to the drawings, in which like numerals refer to like parts throughout the several views. According to one embodiment, FIG. 1 shows an elevation view of an antenna unit 100 serving one sector of an Azimuthal Span, e.g., for Channel 1. The unit 100 is structured with four separate antennas 102 (i.e., 102-1, 102-2, 102-3 and 102-4) arranged in parallel on a same plane. Depending on implementation and specific requirement, more or less individual antennas may be used. To facilitate the description of the embodiment, four individual antennas are presented and described herein. Those skilled in the art shall understand home to modify the number of antennas given the detailed description herein.

As shown in FIG. 1, there are four vertically polarized antennas or antenna elements 102, lined up in the vertical direction with "a" unit distance apart to form an antenna unit 100, covering one sector of an azimuthal span. The height of each antenna element is "b" unit in length. According to one embodiment, the size or quantity of "a" unit is slightly larger than "b" unit so that there is a small gap between each antenna element. The spacing between each adjacent antenna element is therefore a-b unit. This gap of a-b unit in length is then used to install horizontally polarized antenna unit serving as a second channel for the same sector of the azimuthal span. In one embodiment, "a" is measured about 3 inches and "b" is measured about 2.5 inches.

The antenna elements 102 may be any form of planar antennas (e.g., Yagi antenna). In one embodiment, each of the antenna elements 102 is formed by metal strips fabricated on a PCB board, where the lengths and widths of the strips in parallel are not necessary identical depending on a required azimuthal span or a desired antenna radiation pattern. According to another embodiment, the antenna elements 102 are all formed on a single PCB board, where the PCB board itself is further structured or reshaped to accommodate one or more sets of other antenna sets to meet a requirement of specific antenna radiation pattern. As will be further discussed below, one or more of the elements 102 and/or one or more of the antenna sets can be controlled to form a unique antenna radiation pattern per an application.

Figure 2:
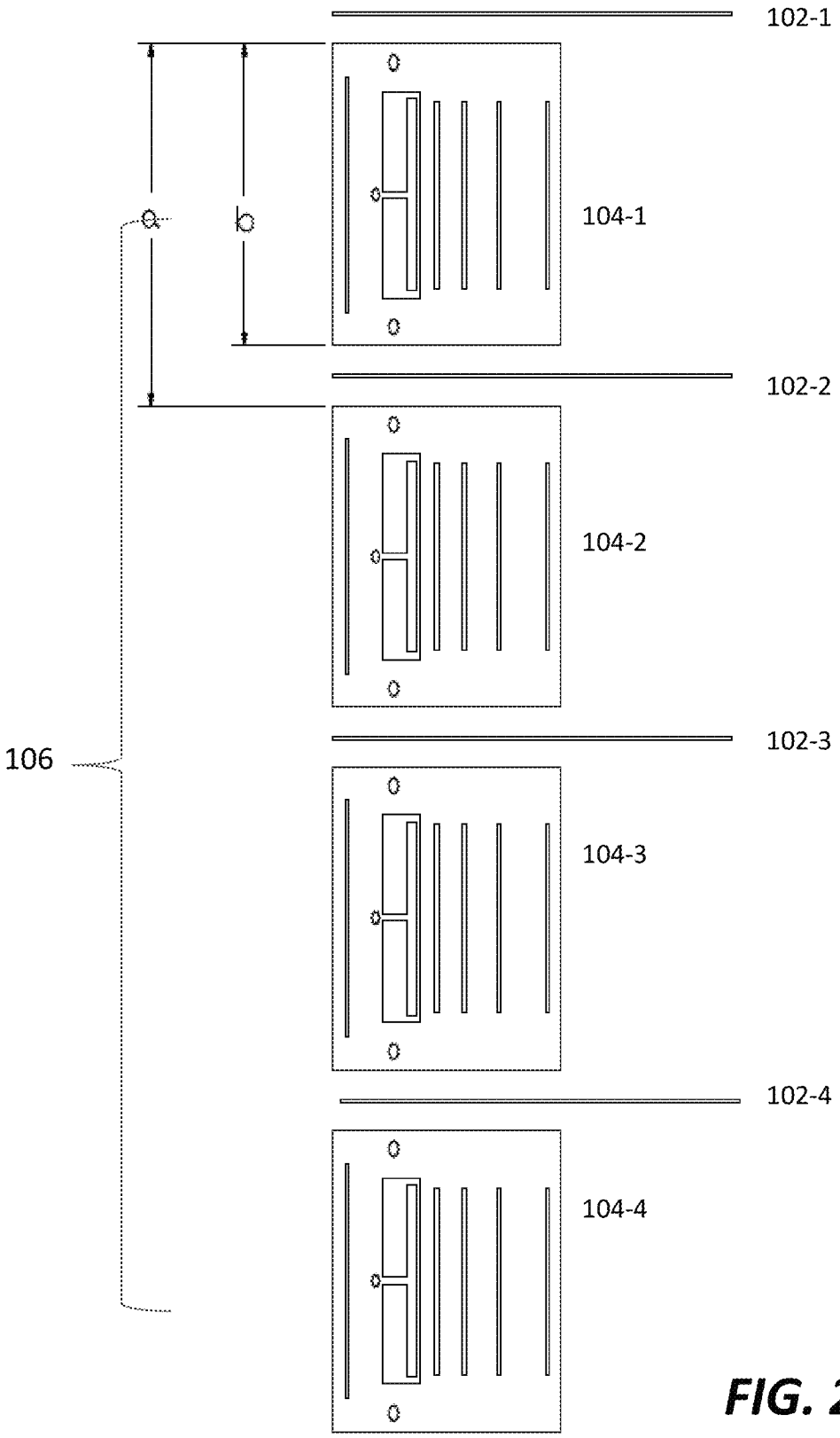
FIG. 2 shows that another set of horizontally polarized antenna elements inserted into the gaps between the vertically polarized antenna elements to form an integrated antenna unit.
Figure 3:
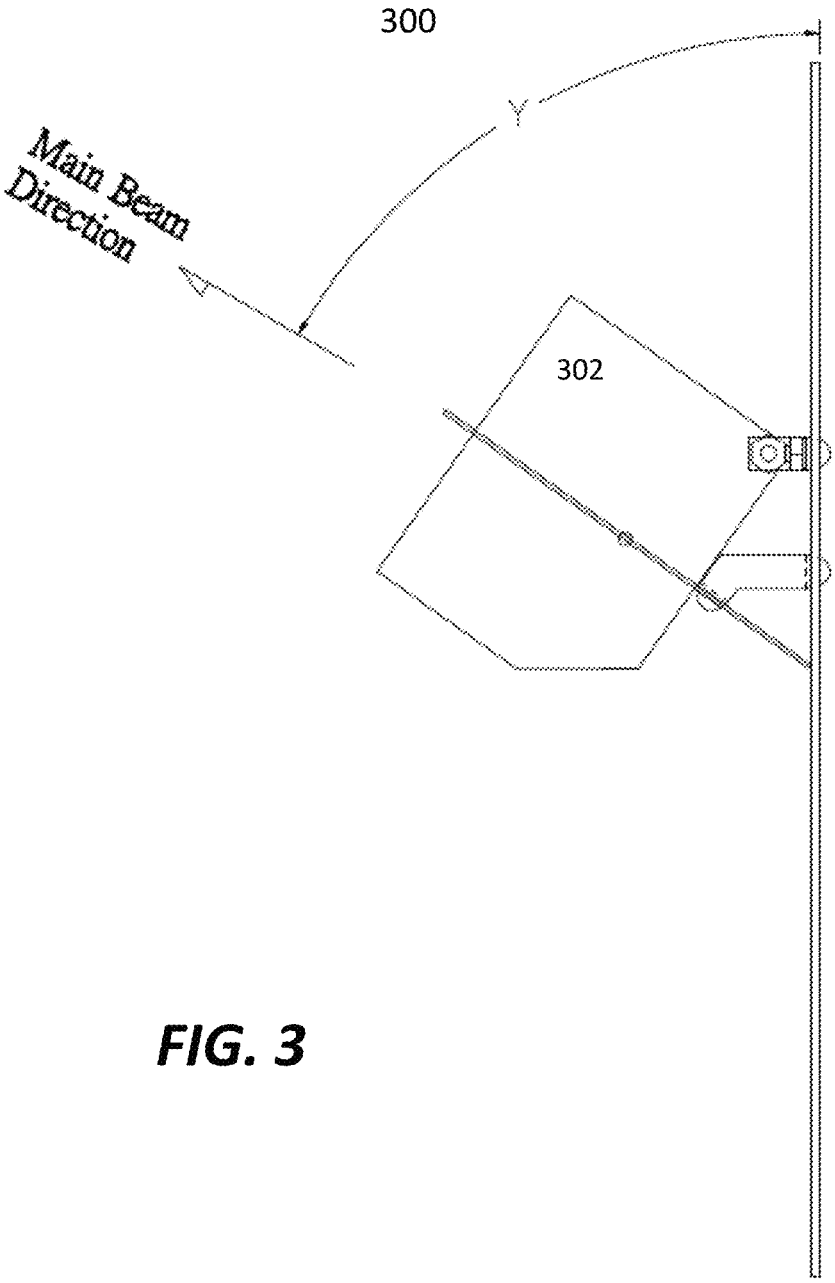
FIG. 3 shows that the main beam directions of both the vertically polarized antenna unit and the horizontally polarized antenna unit form an angular angle, y degrees, with respect to a substrate (e.g., a metal plate)

FIG. 2 shows that there is another set of horizontally polarized antenna elements 104 (i.e., 104-1, 104-2, 104-3 and 104-4) inserted into the gaps between the vertically polarized antenna elements 102 to form an integrated antenna unit 106. FIG. 3 shows that an integrated antenna unit 302 mounted on a substrate, where the main beam directions of both the vertically polarized antenna unit and the horizontally polarized antenna unit in the integrated antenna unit 302 form an angle, y degrees, with respect to the substrate (e.g., a metal plate). The substrate is provided to support the integrated antenna unit or is part of the antenna system.

Figure 4:
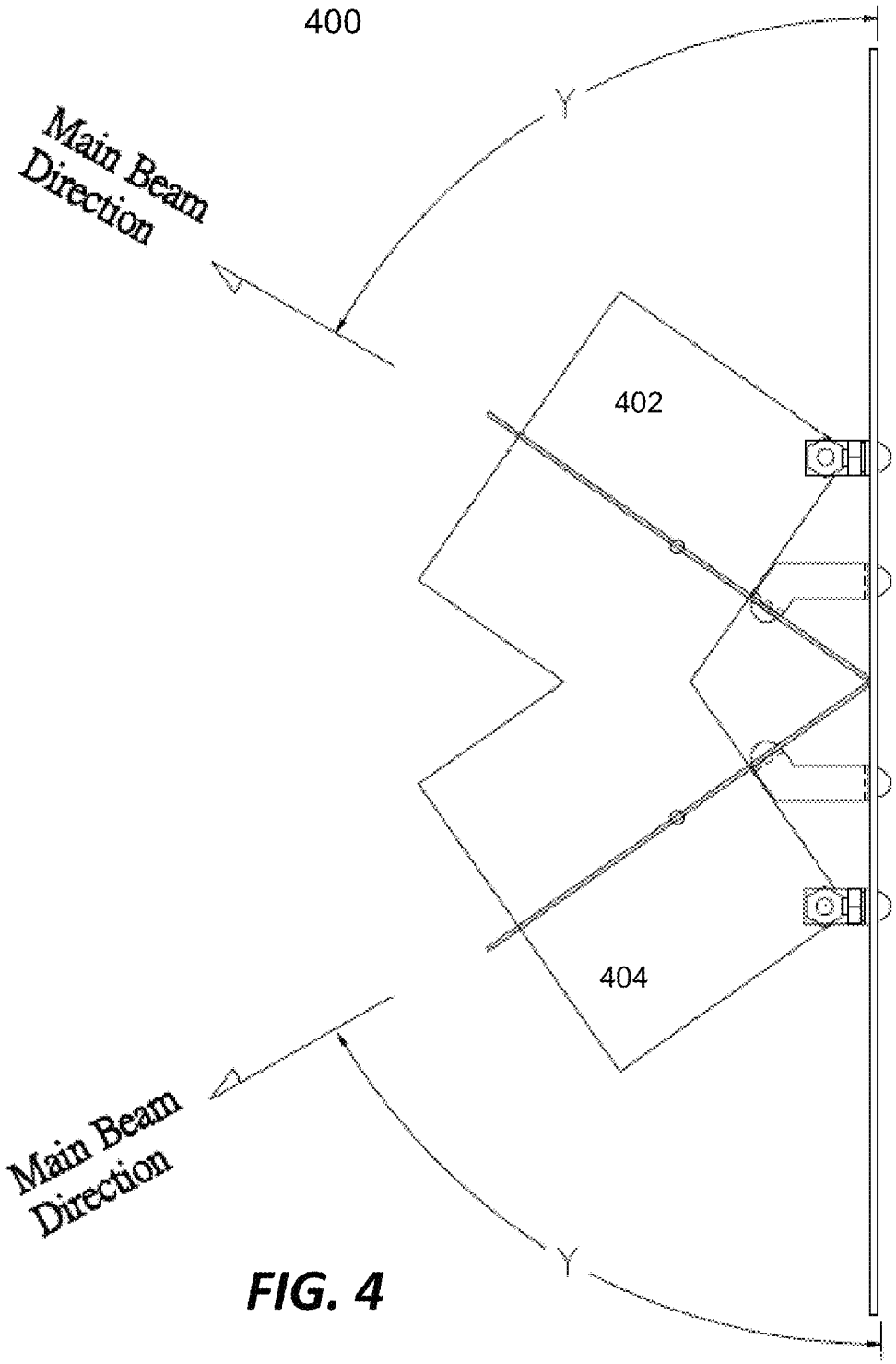
FIG. 4 shows that there are two sets of the integrated antenna units that are arranged with an angular angle therebetween.

Identical antenna units may be used to cover other sectors of a desirable azimuthal span. FIG. 4 shows that there are two sets 402 and 404 of the integrated antenna unit 302 of FIG. 3 and arranged in a way that covers an adjacent sector also forming an angle, y degrees, with respect to the substrate. FIG. 4 shows an antenna system includes two integrated antennas 402 and 404 arranged with an angular angle therebetween. Those skilled in the art shall appreciate that an antenna system designed in accordance with the present invention may include more than two integrated antenna units to form a desired antenna pattern. As described above and further described below, one or more of the elements in the antenna units in FIG. 4 and/or one or more of the integrated antenna units can be controlled to further form a unique antenna radiation pattern per an application.

Figure 5:
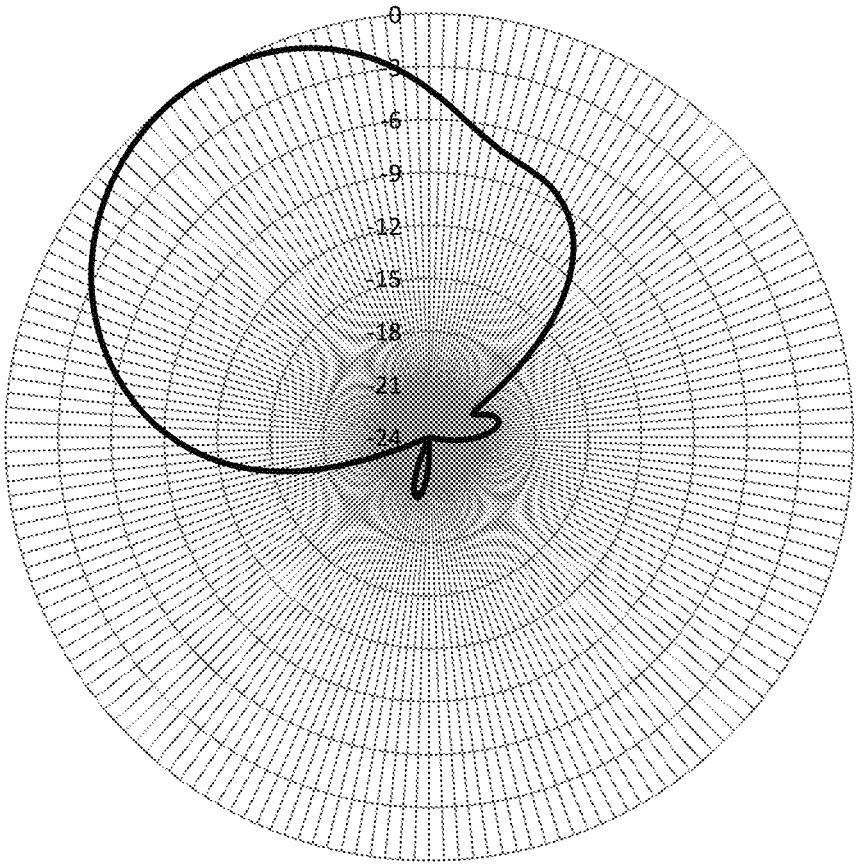
FIG. 5 shows an azimuthal radiation pattern covering one 60-degree sector when the antenna unit of FIG. 1 are fully energized.
Figure 6:
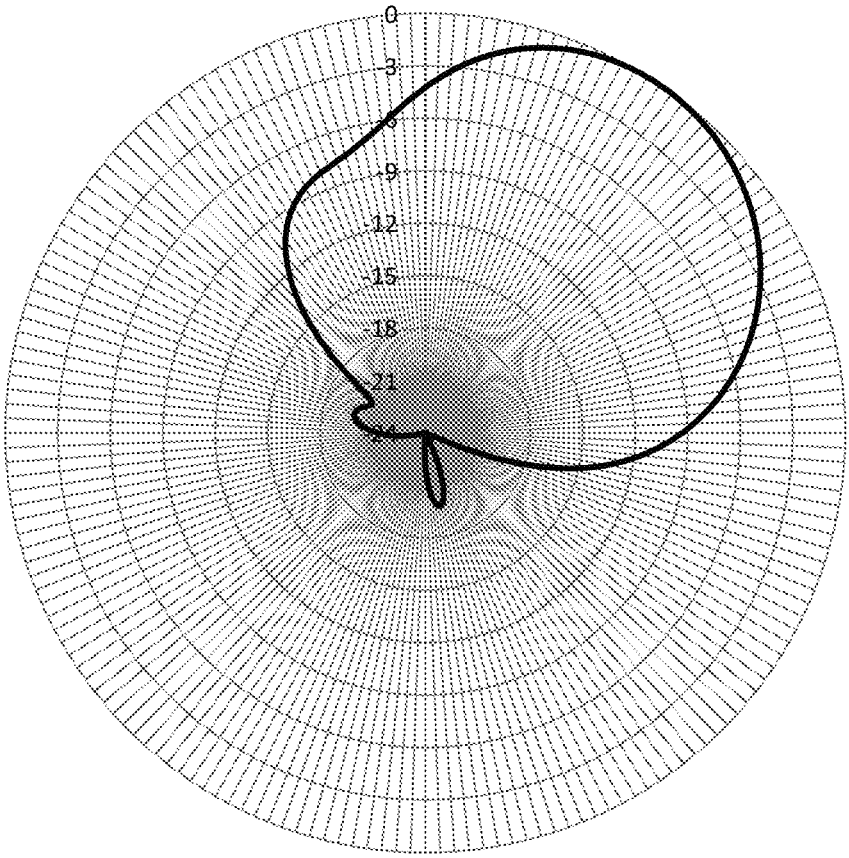
FIG. 6 shows a corresponding azimuthal radiation pattern covering the other 60-degree sector when another set of the antenna unit of FIG. 2 are fully energized.
Figure 7:
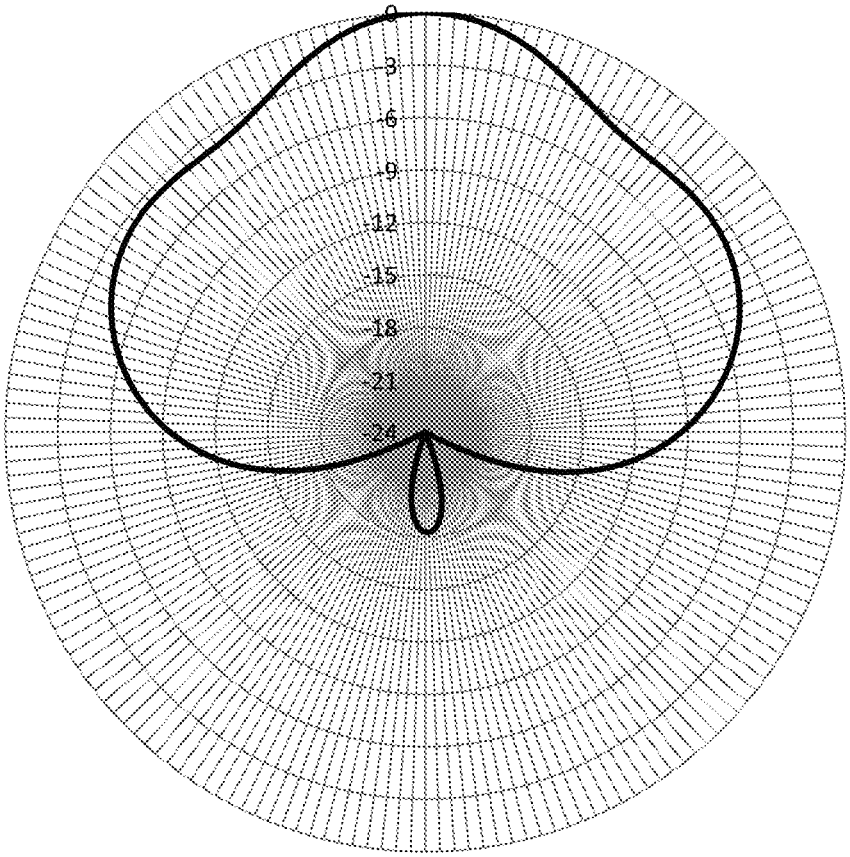
FIG. 7 shows the corresponding azimuthal radiation pattern covering the entire 120-degree sector without developing a null when two sets of the vertically and horizontally polarized antennas are integrated and all are fully energized.

FIG. 5 shows an azimuthal radiation pattern covering one 60-degree sector when the antenna unit 100 of FIG. 1 or the antenna unit 106 of FIG. 2 is fully energized. FIG. 4 shows that there are two integrated antenna sets 402 and 404. FIG. 6 shows a corresponding azimuthal radiation pattern covering another 60-degree sector when the antenna structure similar to the antenna unit 100 or 106 in the second integrated antenna set is fully energized. When two sets of the vertically and horizontally polarized antennas (i.e., the antenna units 100 and 106) are integrated and all are fully energized, FIG. 7 shows the corresponding azimuthal radiation pattern covering the entire 120-degree sector without developing a null (e.g., with all horizontally polarized antenna units or all vertically polarized antenna units energized).

Figure 8:
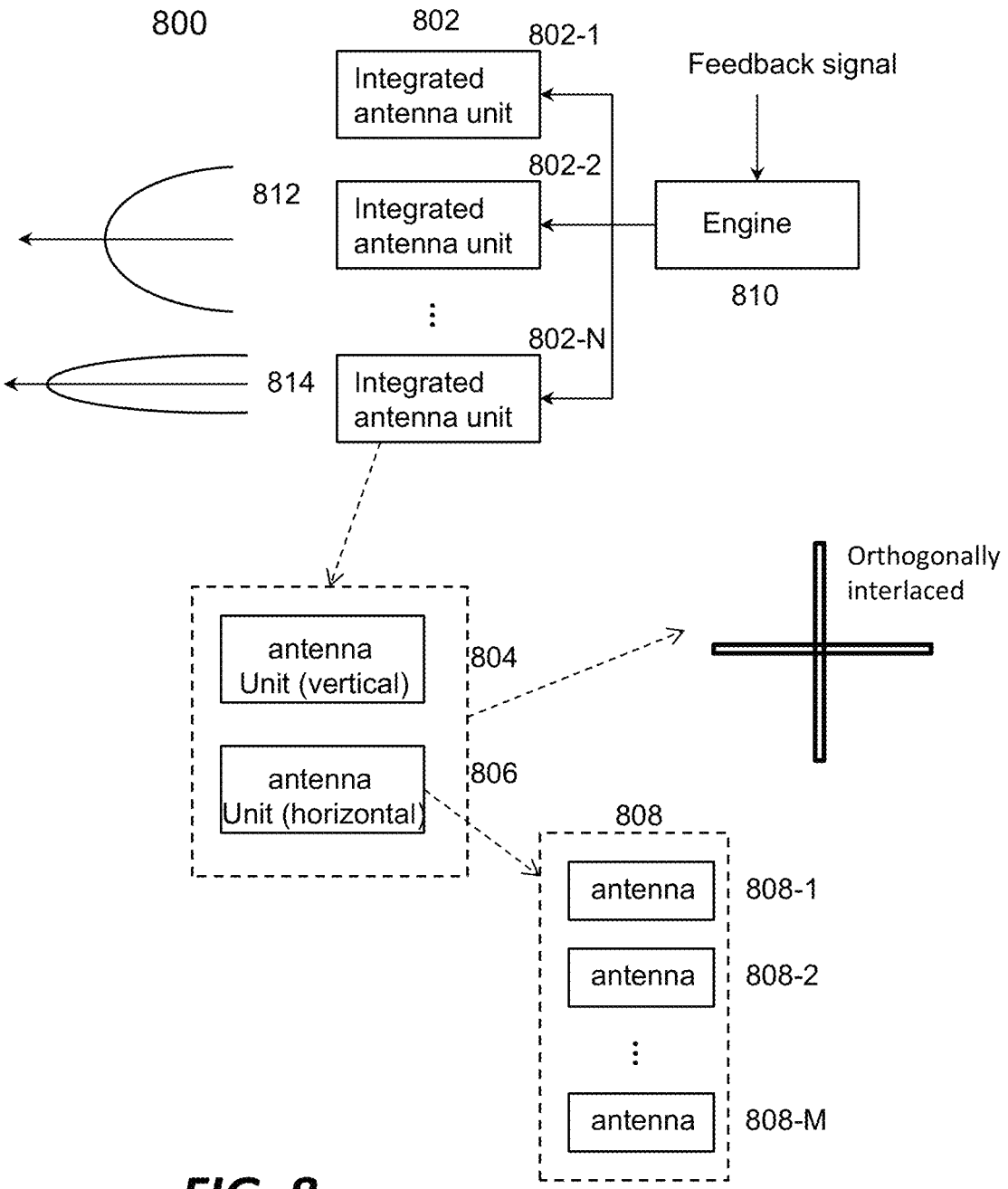
FIG. 8 shows a system block diagram of an antenna system according to one embodiment of the present invention.

FIG. 8 shows a system block diagram of an antenna system 800 according to one embodiment of the present invention. As shown in FIG. 8, the antenna system 800 is structured with or includes a plurality of integrated antenna units 802, each of the integrated antennas units 802 includes two antenna units 804 and 806, one is a horizontally polarized antenna and the other is a vertically polarized antenna. Each of the antenna units 804 and 806 includes an array of antennas 808. The antenna units 804 and 806 are integrated orthogonally with the antennas thereof interlaced as shown in FIG. 2.

In operation, the antenna system 800 is energized by an engine 810. In transmitting mode, the engine 810 feeds a transmitting signal to the antenna system 800. In receiving mode, the engine 810 is configured to receive the signal from the antenna system 800. For better reception, in responding to a signal provided to the engine 810 the engine 810 is configured to dynamically change the antenna pattern by selectively driving one or more of the antennas 808, one or more of the antenna units 804 and 806, or one or more of the integrated antennas units 802.

In an exemplary application, an access point (e.g., a Wi-Fi device) is equipped with the antenna system 100 and is accessed by a mobile device. The default antenna pattern 812 of the antenna system 100 (when all elements are energized) is no longer efficient. Ideally, the antenna pattern of the antenna system 100 shall be more directional towards the mobile device. Based on the RF signals exchanged between the two devices, the engine 810 can be figured to selectively energize one or more of the antenna elements in the antenna system 800 to reshape the default antenna pattern 812 to a newly formed antenna pattern 814.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. Accordingly, the scope of the present invention is defined by the appended claims rather than the forgoing description of embodiments.

We claim:

1. An antenna system comprises:

a flat substrate;

a first integrated antenna unit, including a first array of antennas spaced apart to accommodate a second array of antennas in an interlacing fashion along a first axis, mounted to at least a first bracket affixed to the substrate;

a second integrated antenna unit, including a first array of antennas spaced apart to accommodate a second array of antennas in an interlacing fashion along a second axis, mounted to at least a second bracket affixed to the substrate, each of the first and second integrated antenna units respectively adjusted around the first axis or the second axis with respect to the substrate such that main beam directions of the first and second integrated antenna units are formed with an angle towards the substrate, wherein the angle is less than 90 degrees, each of the antennas being substantially identical in size and structure.

2. The antenna system as recited in claim 1, further including a control unit provided to selectively energize the antennas in each of the first and second integrated antenna units to dynamically form a desired antenna pattern.

3. The antenna system as recited in claim 2, wherein the desired pattern is determined in accordance with a signal measured from communication between a device equipped with the antenna system and another device.

4. The antenna system as recited in claim 3, wherein the device is a Wi-Fi router and the another device is a mobile device.

5. The antenna system as recited in claim 1, wherein the antenna system is provided to an access point in a Wi-Fi environment and is accessed by a mobile device, an updated antenna pattern of the antenna system is made more directional towards the mobile device when a default antenna pattern of the antenna system is no longer efficient to the mobile device, wherein one or more of the antennas in the antenna system are selectively energized to reshape the default antenna pattern to the updated antenna pattern.

6. The antenna system as recited in claim 5, wherein the one or more of the antennas in the antenna system are selected based on RF signals exchanged between a control unit and the mobile device, wherein the control unit is provided to drive the antenna system.

7. The antenna system as recited in claim 1, wherein each of the antennas in the first and second integrated antenna units is formed with a plurality of metal strips in parallel, with varying lengths and widths.

8. The antenna system as recited in claim 7, wherein each of the first and second integrated antenna units is provided to serve a different channel for a sector.

9. The antenna system as recited in claim 7, wherein each of the first and second integrated antenna units has its own antenna pattern, the antenna system with the first and second integrated antenna units integrated in an interlacing fashion develops a unique antenna without a null.

10. The antenna system as recited in claim 1, wherein each of the first and second integrated antenna units includes a vertically polarized antenna unit and a horizontally polarized antenna unit.

* * * * *